US005706906A

United States Patent [19]

Jurewicz et al.

[11] Patent Number: 5,706,906

[45] Date of Patent: Jan. 13, 1998

[54] SUPERABRASIVE CUTTING ELEMENT WITH ENHANCED DURABILITY AND INCREASED WEAR LIFE, AND APPARATUS SO EQUIPPED

[75] Inventors: Stephen R. Jurewicz, South Jordan; Kenneth M. Jensen, Orem; Gordon A. Tibbitts, Salt Lake City, all of Utah

[73] Assignee: Baker Hughes Incorporated, Houston, Tex.

[21] Appl. No.: 602,076

[22] Filed: Feb. 15, 1996

[51] Int. Cl.[6] ..... E21B 10/46; E21B 10/58

[52] U.S. Cl. ..... 175/428; 175/430

[58] Field of Search ..... 175/428, 430, 175/431, 432, 434

[56] References Cited

U.S. PATENT DOCUMENTS

| | | |
|---|---|---|
| 3,745,623 | 7/1973 | Wentorf, Jr. et al. . |
| 4,109,737 | 8/1978 | Boverkerk . |
| 4,323,130 | 4/1982 | Dennis . |
| 4,381,825 | 5/1983 | Radtke . |
| 4,396,077 | 8/1983 | Radtke . |
| 4,410,054 | 10/1983 | Nagel et al. . |
| 4,442,909 | 4/1984 | Radtke . |
| 4,478,298 | 10/1984 | Hake et al. . |
| 4,494,618 | 1/1985 | Radtke . |
| 4,498,549 | 2/1985 | Jürgens . |
| 4,499,795 | 2/1985 | Radtke . |
| 4,499,958 | 2/1985 | Radtke et al. . |
| 4,545,441 | 10/1985 | Williamson . |
| 4,592,433 | 6/1986 | Dennis . |
| 4,593,777 | 6/1986 | Barr . |
| 4,607,711 | 8/1986 | Zijsling . |
| 4,632,196 | 12/1986 | Dennis . |
| 4,690,691 | 9/1987 | Komanduri . |
| 4,702,649 | 10/1987 | Komanduri . |
| 4,705,123 | 11/1987 | Dennis . |
| 4,714,385 | 12/1987 | Komanduri . |
| 4,724,913 | 2/1988 | Morris . |

(List continued on next page.)

FOREIGN PATENT DOCUMENTS

| | | |
|---|---|---|
| 0 219 959 | 4/1987 | European Pat. Off. . |
| 0 411 831 | 2/1991 | European Pat. Off. . |
| 2240797 | of 1991 | United Kingdom . |
| 2193740 | 2/1997 | United Kingdom . |

OTHER PUBLICATIONS

Letter of May 17, 1996 from Daniel McCarthy to Joseph A. Walkowski regarding "US Synthetic MXD Cutter and Prior Art" (5 pages) with eleven (11) pages of attachments including a table entitled U.S. Synthetic Large Chamfer Products (1 page) and ten (10) pages of undated drawing designated, in the order set forth in the table and following therebehind, as 1303RC–DSC, 1308RC–DSC, 1908RC–DSC, 0808FMT, 1303FMT, 1308FMT, 1908FMT, 1308F Shaped, 1313RC S–CHM, 1913RC S–CHM.

Letter of May 31, 1996 from Daniel McCarthy to Joseph A. Walkowski regarding "US Synthetic and MXD Cutters" (3 pages) with attachments 1 through 8.

IBM technical disclosure bulletin, vol. 13, No. 11, Apr. 1971.

Ortega et al., "Frictional Heating and Convective Cooling of Polycrystalline Diamond Drag Tools During Rock Cutting," SPE, 1982.

*Primary Examiner*—David J. Bagnell
*Attorney, Agent, or Firm*—Trask, Britt & Rossa

[57] ABSTRACT

A cutting element for use in drilling subterranean formations. The cutting element includes a superabrasive table between about 0.070 inch and 0.150 inch thickness, mounted to a supporting substrate. The superabrasive table includes a two-dimensional cutting face having a cutting edge along at least a portion of its periphery, and a rake land extending forwardly and inwardly from the cutting edge at an angle of between about 10° and 80° to the longitudinal axis of the cutting element for a width, measured along the surface of the rake land, of not less than about 0.050 inch. The interface between the superabrasive volume and the substrate, taken to the rear of the cutting edge, is located no less than about 0.015 inch to the rear of the cutting edge.

47 Claims, 9 Drawing Sheets

U.S. PATENT DOCUMENTS 4,729,440 3/1988 Hall .
4,764,434 8/1988 Aronsson et al. .
4,784,023 11/1988 Dennis .
4,792,001 12/1988 Zijsling .
4,797,138 1/1989 Komanduri .
4,858,707 8/1989 Jones et al. .
4,869,330 9/1989 Tibbitts .
4,872,520 10/1989 Nelson .
4,926,950 5/1990 Zijsling .
4,976,324 12/1990 Tibbitts .
4,984,642 1/1991 Renard et al. .
4,987,800 1/1991 Gasan et al. .
5,011,515 4/1991 Frushour .
5,016,718 5/1991 Tandberg .
5,027,912 7/1991 Juergens .
5,045,092 9/1991 Keshavan .
5,054,246 10/1991 Phaal et al. .
5,103,922 4/1992 Jones .
5,119,714 6/1992 Scott et al. .
5,120,327 6/1992 Dennis .
5,127,923 7/1992 Bunting et al. .
5,135,061 8/1992 Newton, Jr. .
5,154,245 10/1992 Waldenström et al. .
5,159,857 11/1992 Jurewicz .
5,161,627 11/1992 Burkett .
5,173,090 12/1992 Scott et al. .
5,199,512 4/1993 Curlett .
5,238,074 8/1993 Tibbitts et al. .
5,248,006 9/1993 Scott et al. .
5,264,283 11/1993 Waldenström et al. .
5,273,125 12/1993 Jurewicz .
5,279,375 1/1994 Tibbitts et al. .
5,291,957 3/1994 Curlett .
5,301,762 4/1994 Besson .
5,314,033 5/1994 Tibbitts .
5,316,095 5/1994 Tibbitts .
5,332,051 7/1994 Knowlton .
5,335,738 8/1994 Waldenström et al. .
5,337,844 8/1994 Tibbitts .
5,346,026 9/1994 Pessier et al. .
5,351,772 10/1994 Smith .
5,355,969 10/1994 Hardy et al. .
5,370,717 12/1994 Lloyd et al. .
5,379,853 1/1995 Lockwood et al. .
5,379,854 1/1995 Dennis .
5,433,280 7/1995 Smith .
5,435,403 7/1995 Tibbitts .
5,437,343 8/1995 Cooley et al. .
5,443,565 8/1995 Strange, Jr. .
5,447,208 9/1995 Lund et al. .
5,460,233 10/1995 Meany et al. .
5,467,836 11/1995 Grimes et al. ..... 175/401
5,499,688 3/1996 Dennis ..... 175/426

SUPERABRASIVE CUTTING ELEMENT WITH ENHANCED DURABILITY AND INCREASED WEAR LIFE, AND APPARATUS SO EQUIPPED

BACKGROUND OF THE INVENTION

1. Field of the Invention

This invention relates to devices used in drilling and boring through subterranean formations. More particularly, this invention relates to a polycrystalline diamond or other superabrasive cutter intended to be installed on a drill bit or other tool used for earth or rock boring, such as may occur in the drilling or enlarging of an oil, gas, geothermal or other subterranean borehole, and to bits and tools so equipped.

2. State of the Art

There are three types of bits which are generally used to drill through subterranean formations. These bit types are: (a) percussion bits (also called impact bits); (b) rolling cone bits, including tri-cone bits; and (c) drag bits or fixed cutter rotary bits (including core bits so configured), the majority of which currently employ diamond or other superabrasive cutters, polycrystalline diamond compact (PDC) cutters being most prevalent.

In addition, there are other structures employed downhole, generically termed "tools" herein, which are employed to cut or enlarge a borehole or which may employ superabrasive cutters, inserts or plugs on the surface thereof as cutters or wear-prevention elements. Such tools might include, merely by way of example, reamers, stabilizers, tool joints, wear knots and steering tools. There are also formation cutting tools employed in subterranean mining, such as drills and boring tools.

Percussion bits are used with boring apparatus known in the art that moves through a geologic formation by a series of successive impacts against the formation, causing a breaking and loosening of the material of the formation. It is expected that the cutter of the invention will have use in the field of percussion bits.

Bits referred to in the art as rock bits, tri-cone bits or rolling cone bits (hereinafter "rolling cone bits") are used to bore through a variety of geologic formations, and demonstrate high efficiency in firmer rock types. Prior art rolling cone bits tend to be somewhat less expensive than PDC drag bits, with limited performance in comparison. However, they have good durability in many hard-to-drill formations. An exemplary prior art rolling cone bit is shown in FIG. 2. A typical rolling cone bit operates by the use of three rotatable cones oriented substantially transversely to the bit axis in a triangular arrangement, with the narrow cone ends facing a point in the center of the triangle which they form. The cones have cutters formed or placed on their surfaces. Rolling of the cones in use due to rotation of the bit about its axis causes the cutters to imbed into hard rock formations and remove formation material by a crushing action. Prior art rolling cone bits may achieve a rate of penetration (ROP) through a hard rock formation ranging from less than one foot per hour up to about thirty feet per hour. It is expected that the cutter of the invention will have use in the field of rolling cone bits as a cone insert for a rolling cone, as a gage cutter or trimmer, and on wear pads on the gage.

A third type of bit used in the prior art is a drag bit or fixed-cutter bit. An exemplary drag bit is shown in FIG. 1. The drag bit of FIG. 1 is designed to be turned in a clockwise direction (looking downward at a bit being used in a hole, or counterclockwise if looking at the bit from its cutting end as shown in FIG. 1) about its longitudinal axis. The majority of current drag bit designs employ diamond cutters comprising polycrystalline diamond compacts (PDCs) mounted to a substrate, typically of cemented tungsten carbide (WC). State-of-the-art drag bits may achieve an ROP ranging from about one to in excess of one thousand feet per hour. A disadvantage of state-of-the-art PDC drag bits is that they may prematurely wear due to impact failure of the PDC cutters, as such cutters may be damaged very quickly if used in highly stressed or tougher formations composed of limestones, dolomites, anhydrites, cemented sandstones interbedded formations such as shale with sequences of sandstone, limestone and dolomites, or formations containing hard "stringers." It is expected that the cutter of the invention will have use in the field of drag bits as a cutter, as a gage cutter or trimmer, and on wear pads on the gage.

As noted above, there are additional categories of structures or "tools" employed in boreholes, which tools employ superabrasive elements for cutting or wear prevention purposes, including reamers, stabilizers, tool joints, wear knots and steering tools. It is expected that the cutter of the present invention will have use in the field of such downhole tools for such purposes, as well as in drilling and boring tools employed in subterranean mining.

It has been known in the art for many years that PDC cutters perform well on drag bits. A PDC cutter typically has a diamond layer or table formed under high temperature and pressure conditions to a cemented carbide substrate (such as cemented tungsten carbide) containing a metal binder or catalyst such as cobalt. The substrate may be brazed or otherwise joined to an attachment member such as a stud or to a cylindrical backing element to enhance its affixation to the bit face. The cutting element may be mounted to a drill bit either by press-fitting or otherwise locking the stud into a receptacle on a steel-body drag bit, or by brazing the cutter substrate (with or without cylindrical backing) directly into a preformed pocket, socket or other receptacle on the face of a bit body, as on a matrix-type bit formed of WC particles cast in a solidified, usually copper-based, binder as known in the art.

A PDC is normally fabricated by placing a disk-shaped cemented carbide substrate into a container or cartridge with a layer of diamond crystals or grains loaded into the cartridge adjacent one face of the substrate. A number of such cartridges are typically loaded into an ultra-high pressure press. The substrates and adjacent diamond crystal layers are then compressed under ultra-high temperature and pressure conditions. The ultra-high pressure and temperature conditions cause the metal binder from the substrate body to become liquid and sweep from the region behind the substrate face next to the diamond layer through the diamond grains and act as a reactive liquid phase to promote a sintering of the diamond grains to form the polycrystalline diamond structure. As a result, the diamond grains become mutually bonded to form a diamond table over the substrate face, which diamond table is also bonded to the substrate face. The metal binder may remain in the diamond layer within the pores existing between the diamond grains or may be removed and optionally replaced by another material, as known in the art, to form a so-called thermally stable diamond ("TSD"). The binder is removed by leaching or the diamond table is formed with silicon, a material having a coefficient of thermal expansion (CTE) similar to that of diamond. Variations of this general process exist in the art, but this detail is provided so that the reader will understand the concept of sintering a diamond layer onto a substrate in order to form a PDC cutter. For more background information concerning processes used to form polycrystalline diamond cutters, the reader is directed to U.S. Pat. No. 3,745,623, issued on Jul. 17, 1973, in the name of Wentoff, Jr. et at.

Prior art PDCs experience durability problems in high load applications. They have an undesirable tendency to crack, spall and break when exposed to hard, tough or highly stressed geologic structures so that the cutters sustain high loads and impact forces. They are similarly weak when placed under high loads from a variety of angles. The durability problems of prior art PDCs are worsened by the dynamic nature of both normal and torsional loading during the drilling process, wherein the bit face moves into and out of contact with the uncut formation material forming the bottom of the wellbore, the loading being further aggravated in some bit designs and in some formations by so-called bit "whirl."

The diamond table/substrate interface of conventional PDCs is subject to high residual stresses arising from formation of the cutting element, as during cooling the differing coefficients of thermal expansion of the diamond and substrate material result in thermally-induced stresses. In addition, finite element analysis (FEA) has demonstrated that high tensile stresses exist in a localized region in the outer cylindrical substrate surface and internally in the substrate. Both of these phenomena are deleterious to the life of the cutting element during drilling operations as the stresses, when augmented by stresses attributable to the loading of the cutting element by the formation, may cause spalling, fracture or even delamination of the diamond table from the substrate.

Further, high tangential loading of the cutting edge of the cutting element results in bending stresses on the diamond table, which is relatively weak in tension and will thus fracture easily if not adequately supported against bending. The metal carbide substrate on which the diamond table is formed are typically of inadequate stiffness to provide a desirable degree of such support.

The relatively thin diamond table of a conventional PDC cutter, in combination with the substrate, also provide lower than optimum heat transfer from the curing edge of the curing face, and external cooling of the diamond table as by directed drilling fluid flow from nozzles on the bit face is only partially effective in reducing the potential for heat-induced damage.

The relatively rapid wear of conventional, thin diamond tables of PDC cutters also results in rapid formation of a wear flat in the substrate backing the cutting edge, the wear flat reducing the per-unit area loading in the vicinity of the curing edge and requiring greater weight on bit (WOB) to maintain rate of penetration (ROP). The wear flat, due to the introduction of the substrate material as a contact surface with the formation, also increases drag or frictional contact between the cutter and the formation due to modification of the coefficient of friction. As one result, frictional heat generation is increased, elevating temperatures in the cutter, while at the same time the presence of the wear flat reduces the opportunity for access by drilling fluid to the immediate rear of the cutting edge of the diamond table.

Others have previously attempted to enhance the durability of conventional PDC cutters. By way of example, the reader is directed to U.S. Pat. No. 32,036 to Dennis (the '036 patent); U.S. Pat. No. 4,592,433 to Dennis (the '433 patent); and U.S. Pat. No. 5,120,327 to Dennis (the '327 patent). In FIG. 5A of the '036 patent, a cutter with a beveled peripheral edge is depicted, and briefly discussed at col. 3, lines 51–54. In FIG. 4 of the '433 patent, a very minor beveling of the peripheral edge of the cutter substrate or blank having grooves of diamond therein is shown (see col. 5, lines 1–2 of the patent for a brief discussion of the bevel). Similarly, in FIGS. 1–6 of the '327 patent, a minor peripheral bevel is shown (see col. 5, lines 40–42 for a brief discussion of the bevel). Such bevels or chamfers were originally designed to protect the cutting edge of the PDC while a stud carrying the curing element was pressed into a pocket in the bit face. However, it was subsequently recognized that the bevel or chamfer protected the cutting edge from load-induced stress concentrations by providing a small load-bearing area which lowers unit stress during the initial stages of drilling. The cutter loading may otherwise cause chipping or spalling of the diamond layer at an unchamfered cutting edge shortly after a cutter is put into service and before the cutter naturally abrades to a flat surface or "wear flat" at the cutting edge.

It is also known in the art to radius, rather than chamfer, a cutting edge of a PDC cutter, as disclosed in U.S. Pat. No. 5,016,718 to Tandberg. Such radiusing has been demonstrated to provide a load-bearing area similar to that of a small peripheral chamfer on the cutting face.

U.S. Pat. No. 5,351,772 to Smith discloses a PDC cutter having a plurality of internal radial lands to interrupt and redistribute the stress fields at and adjacent the diamond table/substrate interface and provide additional surface area for diamond table/substrate bonding, permitting and promoting the use of a thicker diamond table useful for cutting highly abrasive formations.

U.S. Pat. No. 5,435,403 to Tibbitts discloses a PDC cutter employing a bar-type laterally-extending stiffening structure adjacent the diamond table to reinforce the table against bending stresses.

For other approaches to enhance cutter wear and durability characteristics, the reader is also referred to U.S. Pat. No. 5,437,343, issued on Aug. 1, 1995, in the name of Cooley et at. (the '343 patent); and U.S. Pat. No. 5,460,233, issued on Oct. 24, 1995, in the name of Meany et at. (the '233 patent). In FIGS. 3 and 5 of the '343 patent, it can be seen that multiple, adjacent chamfers are formed at the periphery of the diamond layer (see col. 4, lines 31–68 and cols. 5–6 in their entirety). In FIG. 2 of the '233 patent, it can be seen that the tungsten carbide substrate backing the superabrasive table is tapered at about 10°–15° to its longitudinal axis to provide some additional support against catastrophic failure of the diamond layer (see col. 5, lines 2–67 and col. 6, lines 1–21 of the '233 patent). See also U.S. Pat. No. 5,443,565, issued on Aug. 22, 1995, in the name of Strange for another disclosure of a multi-chamfered diamond table.

While the foregoing patents have achieved some enhancement of cutter durability, there remains a great deal of room for improvement, particularly when it is desired to fabricate a cutter having, as desirable features, a relatively larger and robust diamond volume offering reduced cutter wear characteristics and increased stiffness. Conventional PDCs employ a diamond table on the order of about 0.030 inches thickness. So-called "double-thick", or 0.060 inch thick diamond tables have been attempted, but without great success due to low strength and wear resistance precipitated to some degree by poorly-sintered diamond tables. It has even been proposed to fabricate PDC cutters with still-thicker chamfered diamond tables, as thick as 0.118 inches, as disclosed in U.S. Pat. No. 4,792,001 to Zijsling. However, the inventors are not aware of the actual manufacture of any such cutters.

SUMMARY OF THE INVENTION

In contrast to the prior art, the cutter of the present invention comprises a PDC or other compact of other superabrasive table of substantially enhanced thickness and durability. The cutter provides a dramatic improvement in impact performance in comparison to conventional PDC cutters, with higher stiffness and consequent enhanced resistance to drilling-induced bending stress. The physical cutting face configuration provides lower unit stresses on the curing face during drilling and reduces the formation loads acting to bend the diamond table. The enhanced-thickness diamond table also affords better heat transfer. The cutting face configuration combined with the thick diamond table distributes the load on the diamond table and provides a larger stress gradient within the diamond material, contributing to the cutter's ability to accommodate higher loads than conventional cutters. It is notable that the curing face configuration, in combination with the enhanced-thickness diamond table, may provide continuous superabrasive material in the depth of cut (DOC) taken by the cutter, in contrast to conventional PDC cutters wherein the WC substrate backing the diamond table (and thus the interface between the two materials) is in the cut. The material continuity again enhances the ability of the cutter to absorb elevated loads without damage.

It is a feature of the invention that the invented cutter has a preferred diamond table thickness of at least 0.070 inch, with a preferred thickness range of about 0.070 inch to 0.150 inch, and a currently most-preferred thickness range of about 0.080 inch to 0.100 inch, although other thicknesses slightly less than, to significantly more than, the preferred range are contemplated as being encompassed by the invention. Such thicknesses substantially enhance the stiffness of the diamond table and hence its resistance to bending.

It is another feature of the invention that a large or radially wide peripheral rake land is provided on the cutting face of the diamond table. The presence of the rake land reduces the stress per unit area on the cutting face in the area or region of contact with the formation due to normal (weight on bit) and tangential (bit rotation) forces acting on the cutter, and decreases the segment or portion of the resultant force vector applied to the cutting face by the formation responsive to the normal and tangential force components and tending to cause bending of the diamond table. An alternative way of stating the effect of the invented large rake land on cutter loading is that a major component of the average resultant force vector on the cutting face is reoriented from a direction which generally parallels the path of rotational cutter movement (i.e. along the side wall of the cutter through the diamond table and substrate adjacent and trailing the cutting edge) toward the center of the cutter in the area of the longitudinal axis of the cutter, the longitudinal axis extending generally transversely to the plane of the cutting face. In a cylindrical cutter, as in the preferred embodiment, the longitudinal axis would be coincident with the center line of the cutter.

It is a consequent advantage of the invention that the cutter, for a given depth of cut and formation material being cut, has a substantially enhanced useful life in comparison to prior art PDC cutters due to a greatly reduced tendency to catastrophically spall, chip, crack and break. It has been found that the invented cutter in PDC form may tend to show some cracks after use, but the small cracks surprisingly do not develop into a catastrophic failure of the diamond table as typically occurs in prior art PDC cutters.

It is a feature of the invented cutter that a rake land is provided on the diamond table that is angled at about 10° to about 80° with respect to the line of the side wall of the cutter (assuming the cutter has a sidewall parallel to the longitudinal axis of the cutter). This is the range of rake land angles that the inventors currently believe will yield a cutter that has the extended useful life and desirable performance characteristics found in the preferred embodiments of the invention.

It is an advantage of the invention that the invented cutter has increased strength and impact resistance compared to prior art cutters, while not degrading cutter performance, due to the presence of both a large rake land and a thickened diamond table in comparison to the prior art cutters. As a consequence of such characteristics, the cutter resists chipping, spalling and breaking and offers enhanced service life.

It is an advantage of the invention that the cutter is useful on drag bits, roller cone bits, percussion bits, and downhole tools. The invented cutter, with its superior impact, abrasion and erosion resistance, has application on all of these devices.

It is an advantage of the invention that a cutter is provided which, when installed on a drag bit, enables the drag bit to be used on hard rock formations and softer formations with hard rock stringers therein (mixed interbedded formations) which are currently not economically drillable with PDC cutters.

It is an advantage of the invention that a cutter is provided which can be manufactured using current manufacturing methods, so that little or no retooling is required in order to begin production. The invented cutter can be manufactured essentially as prior art cutters, with the cutting face rake land configuration being achieved during pressing or by grinding or machining a large rake land into a prior art-design cutter having a diamond table of enhanced thickness.

It is a feature of the invention that a cutter is provided which includes a diamond table sintered to a substrate of a cemented metal carbide selected from the group comprising W, Nb, Zr, V, Ta, Ti, W and Hf, and combinations thereof.

BRIEF DESCRIPTION OF THE DRAWINGS

The foregoing and other features and advantages of the invention will become apparent to persons of ordinary skill in the art upon reading the specification in conjunction with the accompanying drawings, wherein.

DETAILED DESCRIPTION OF THE PREFERRED EMBODIMENTS

Figure 1:
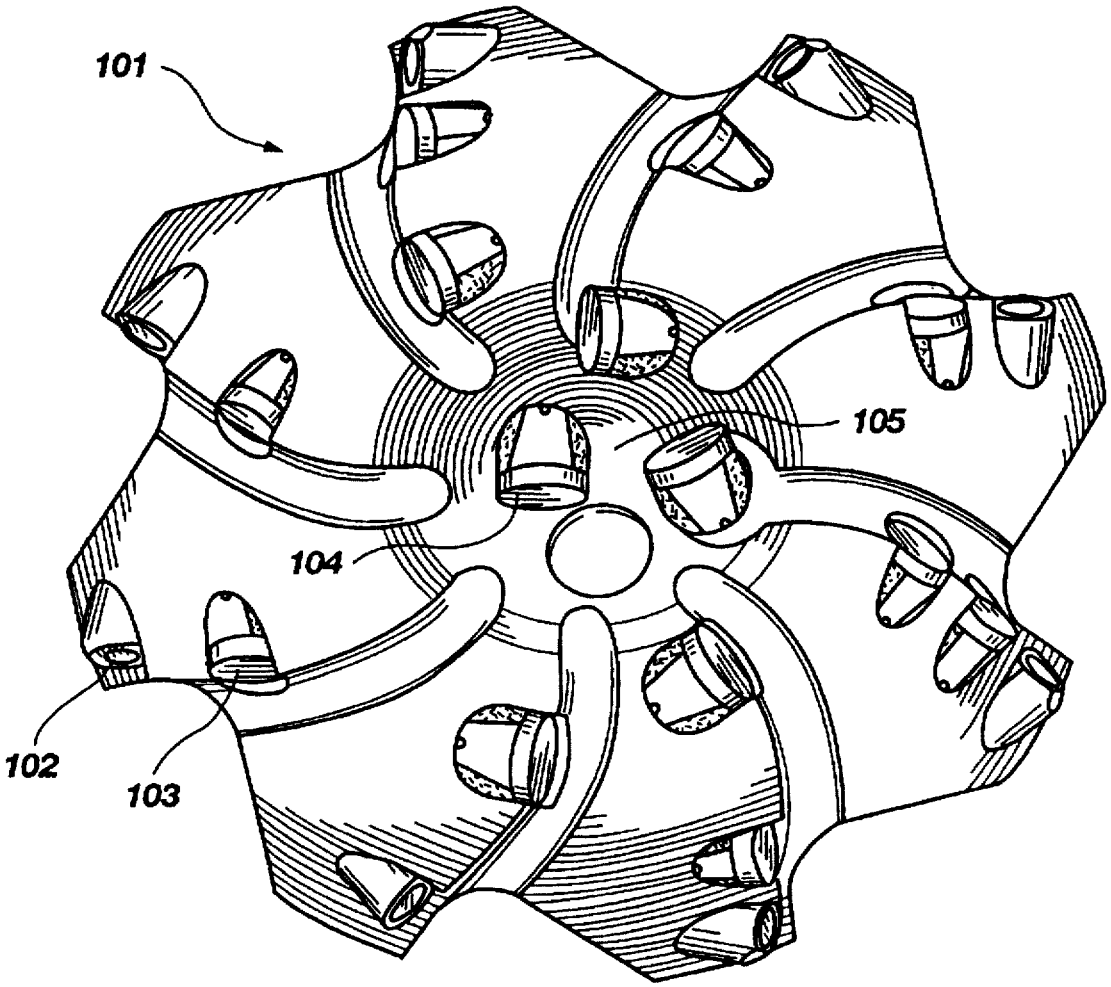
Fig. 1 (PRIOR ART)
FIG. 1 depicts an exemplary prior art drag bit.

Referring to FIG. 1, an exemplary prior art drag bit is illustrated in distal end or face view. The drag bit 101 includes a plurality of cutters 102, 103 and 104 which may be arranged as shown in rows emanating generally radially from approximately the center of the bit 105. The inventors contemplate that the invented cutter will primarily be used on drag bits of any configuration.

Figure 2:
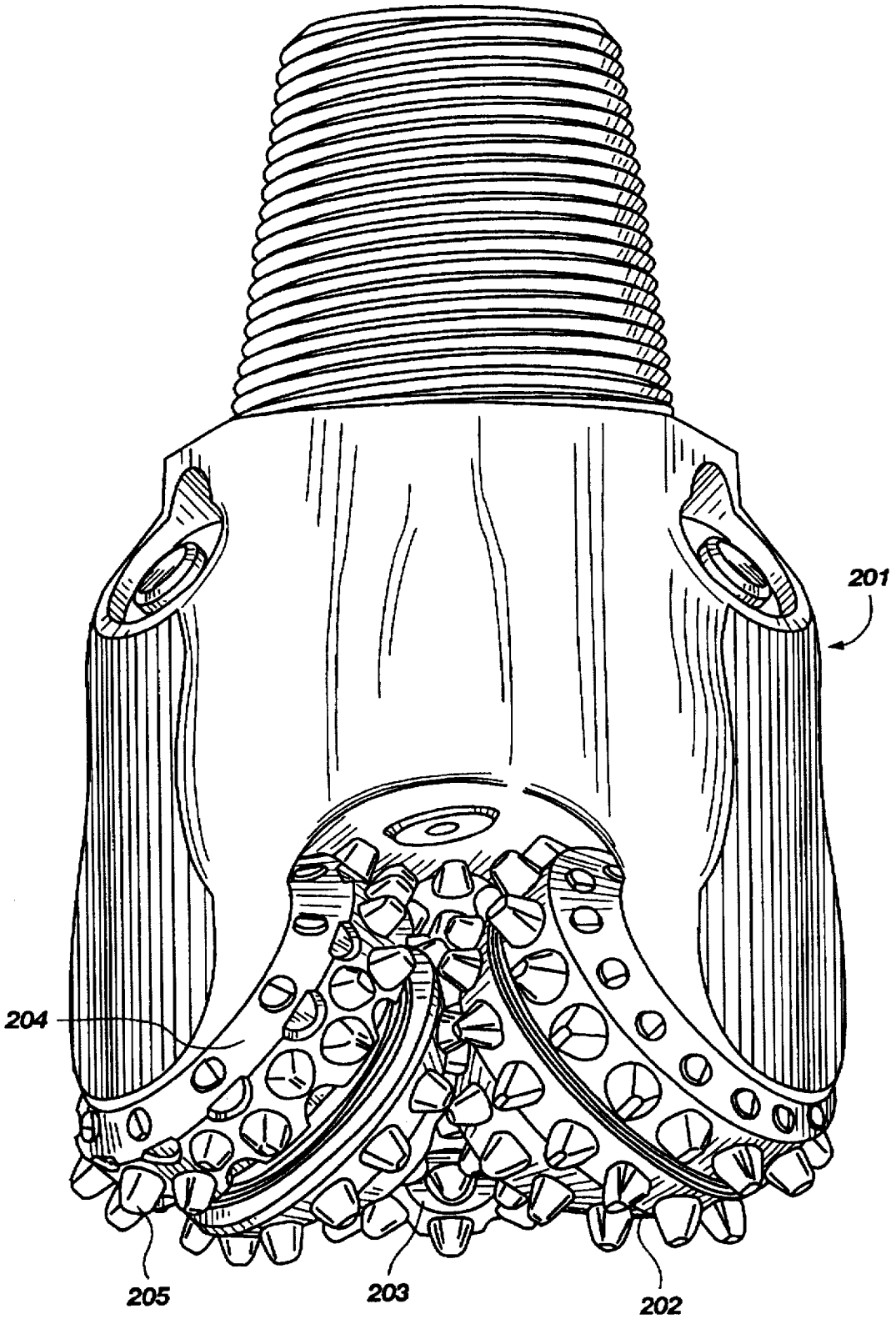
Fig. 2 (PRIOR ART)
FIG. 2 depicts an exemplary prior art roller cone bit.

In FIG. 2, an exemplary prior art roller cone bit is illustrated in side view. The roller cone bit 201 includes three rotatable cones 202, 203 and 204, each of which carries a plurality of cone inserts 205. The inventors contemplate that the invented cutter will also be used on roller cone bits of various configurations in the capacity of cone inserts, gage cutters and on wear pads.

Figure 3:
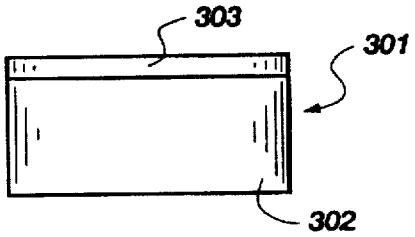
Fig. 3 (PRIOR ART)
FIG. 3 depicts an exemplary prior art diamond cutter.

FIG. 3 depicts a side view of a prior art polycrystalline diamond cutter typically used in drag bits. The cutter 301 is cylindrical in shape and has a substrate 302 which is typically made of cemented carbide such as tungsten carbide (WC) or other materials, depending on the application. The cutter 301 also has a sintered polycrystalline diamond table 303 formed onto substrate 302 by the manufacturing process mentioned above. Cutter 301 may be directly mounted to the face of a drag bit, or secured to a stud which is itself secured to the face of a bit.

Figure 4:
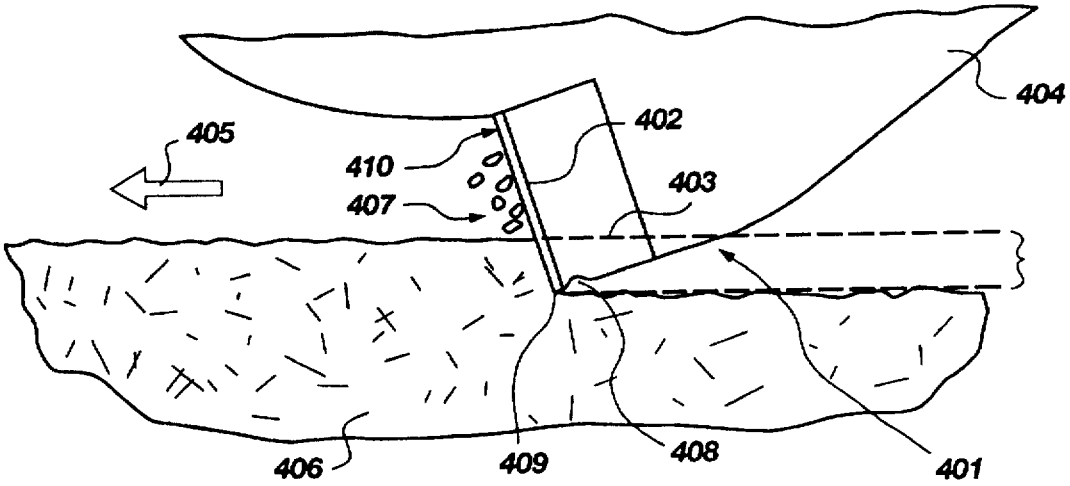
FIG. 4 depicts an exemplary prior art diamond cutter in use.

FIG. 4 depicts a prior art diamond cutter 401, such as the type depicted in FIG. 3, in use on a bit. The cutter 401 has a disc-shaped PDC diamond layer or table 402, typically at 0.020 to 0.030 inches thickness (although as noted before, thicker tables have been attempted), sintered onto a tungsten carbide substrate 403. The cutter 401 is installed on a bit 404. As the bit 404 with cutter 401 move in the direction indicated by arrow 405, the cutter 401 engages rock 406, resulting in shearing of the rock 406 by the diamond layer 402 and sheared rock 407 sliding along the curing face 410 and away from the cutter 401. The reader should note that in plastic subterranean formations, the sheared rock 407 may be very long strips, while in non-plastic formations, the sheared rock 407 may comprise discrete particles, as shown. The curing action of the cutter 401 results in a cut of depth "D" being made in the rock 406. It can also be seen from the figure that on the trailing side of the cutter 401 opposite the cut, both diamond layer 402 and substrate or stud 403 are present within the depth of cut D. This has several negative implications. It has been found that prior art cutters tend to experience abrasive and erosive wear on the substrate 403 within the depth of cut D behind the diamond layer or table 402 under certain curing conditions. This wear is shown at reference numeral 408. Although it may sometimes be beneficial for this wear to occur because of the self-sharpening effect that it provides for the diamond table 402 (enhancing curing efficiency and keeping weight on bit low), wear 408 causes support against bending stresses for the diamond layer 402 to be reduced, and the diamond layer 402 will prematurely spall, crack or break. This propensity to damage is enhanced by the high unit stresses experienced at cutting edge 409 of cutting face 410.

Another problem is that the cutting face diamond layer 402, which is very hard but also very brittle, is supported within the depth of cut D not only by other diamond within the diamond layer 402, but also by a portion of the stud or substrate 403. The substrate is typically tungsten carbide and is of lower stiffness than the diamond layer 402. Consequently, when severe tangential forces are placed on the diamond layer 402 and the supporting substrate 403, the diamond layer 402, which is extremely weak in tension and takes very little strain to failure, tends to crack and break when the underlying substrate 403 flexes or otherwise "gives."

Moreover, when use of a "double thick" (0.060 inch depth) diamond layer was attempted in the prior art, it was found that the thickened diamond layer 502 was also very susceptible to cracking, spalling and breaking. This is believed to be at least in part due to the magnitude, distribution and type (tensile, compressive) residual stresses (or lack thereof) imparted to the diamond table during the manufacturing process, although poor sintering of the diamond table may play a role. The diamond layer and carbide substrate have different thermal expansion coefficients and bulk moduli, which create detrimental residual stresses in the diamond layer and along the diamond/substrate interface. The "thickened" diamond table prior art cutter had substantial residual tensile stresses residing in the substrate immediately behind the cutting edge. Moreover, the diamond layer at the cutting edge was poorly supported, actually largely unsupported by the substrate as shown in FIG. 4, and thus possessed decreased resistance to tangential forces.

For another discussion of the deficiencies of prior art cutters as depicted in FIG. 4, the reader is directed to previously-referenced U.S. Pat. No. 5,460,233. In a cutter configuration as in the prior art (see FIG. 4), it was eventually found that the depth of the diamond layer should be in the range of 0.020 to 0.030 inch for ease of manufacture and a perceived resistance to chipping and spalling. It was generally believed in the prior art that use of a diamond layer greater than 0.035 inches would result in a cutter highly susceptible to breakage, and which would thus have a very short service life.

Reference is made to FIGS. *5a* through *5d* which depict an end view, a side view, an enlarged side view and a perspective view, respectively, of one embodiment of the invented cutter. The cutter 501 is of a shallow frustoconical configuration and includes a circular diamond layer or table 502 (e.g. polycrystalline diamond) bonded (i.e. sintered) to a cylindrical substrate 503 (e.g. tungsten carbide). The interface between the diamond layer and the substrate is, as shown, comprised of mutually parallel ridges separated by valleys, with the ridges and valleys extending laterally across cutter 501 from side to side. Of course, many other interface geometries are known in the art and suitable for use with the invention. The diamond layer 502 is of a thickness "$T_1$." The substrate 503 has a thickness "$T_2$." The diamond layer 502 includes rake land 508 with a rake land angle Θ relative to the side wall 506 of the diamond layer 502 (parallel to the longitudinal axis or center line 507 of the cutter 501) and extending forwardly and radially inwardly toward the longitudinal axis 507. The rake land angle Θ in the preferred embodiment is defined as the included acute angle between the surface of rake land 508 and the side wall 506 of the diamond layer which, in the preferred embodiment, is parallel to longitudinal axis 507. It is preferred for the rake land angle Θ to be in the range of 10° to 80°, but it is most preferred for the rake land angle Θ0 to be in the range of 30° to 60°. However, it is believed to be possible to utilize rake land angles outside of this range and still produce an effective cutter which employs the structure of the invention.

The dimensions of the rake land are significant to performance of the cutter. The inventors have found that the width $w_1$ of the rake land 508 should be at least about 0.050 inches, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land (see FIG. 6). It may also be desirable that the width of the rake land (or height, looking head-on at a moving cutter mounted to a bit) be equal to or greater than the design DOC, although this is not a requirement of the invention.

Diamond layer 502 also includes a cutting face 513 having a flat central area 511 radially inward of rake land, and a cutting edge 509. Between the cutting edge 509 and the substrate 503 resides a portion or depth of the diamond layer referred to as the base layer 510, while the portion or depth between the flat central area 511 of cutting face 513 and the base layer 510 is referred to as the rake land layer 512. The central area 511 of cutting face 513, as depicted in FIGS. *5a, 5b, 5c* and *5d*, is a flat surface oriented perpendicular to longitudinal axis 507. In alternative embodiments of the invention, it is possible to have a convex cutting face area, such as that described in U.S. Pat. No. 5,332,051 to Knowlton. It is also possible to configure such that the land 508 surface of revolution defines a conical point at the center of the cutting face 513. However, the preferred embodiment of the invention is that depicted in FIGS. *5a–5d*.

In the depicted cutter, the thickness $T_1$ of the diamond layer 502 is preferably in the range of 0.070 to 0.150 inch, with a most preferred range of 0.080 to 0.100 inch. This thickness results in a cutter which, in the invented configuration, has substantially improved impact resistance, abrasion resistance and erosion resistance.

In the exemplary preferred embodiment depicted, the base layer 510 thickness $T_3$ is approximately 0.050 inch as measured perpendicular to the supporting face of the substrate, parallel to axis 507. The rake land layer 512 is approximately 0.030 to 0.050 inch thick and the rake angle Θ of the land 508 as shown is 65° but may, as previously noted, vary. The boundary 515 of the diamond layer and substrate to the rear of the cutting edge should lie at least 0.015 inch longitudinally to the rear of the cutting edge and, in the embodiment of FIGS. 5, this distance is substantially greater. The inventors believe that the aforementioned cutting edge to interface distance is at least highly desirable to ensure that the area of highest residual stress (i.e. the area to the rear of the location where the cutting edge of the cutter contacts the formation being cut) is not subject to early point loading, and to ensure that an adequate, rigid mass of diamond and substrate material supports the line of high loading stress.

The diameter of the cutter 501 depicted is approximately 0.750 inches, and the thickness of the substrate 503 $T_2$ is approximately 0.235 to 0.215 inches, although these two dimensions are not critical and larger or smaller diameter cutters with substrates of greater longitudinal extent are contemplated as within the scope of the invention. For example, cutters of approximately 0.529 inch and of substrate thicknesses ranging from about 0.20 inch to about 0.50 inch have also been fabricated in accordance with the present invention.

As shown in FIGS. *5a–5d*, the sidewall 517 of the cutter 501 is parallel to the longitudinal axis 507 of the cutter. Thus, as shown, angle Θ0 equals angle Φ, the angle between rake land 508 and axis 507. However, cutters of the present invention need not be circular or even symmetrical in cross-section, and the cutter sidewall may not always parallel the longitudinal axis of the cutter. Thus, the rake land angle may be set as angle Θ or as angle Φ, depending upon cutter configuration and designer preference. The significant aspect of the invention regarding angular orientation of the rake land is the presentation of the rake land to the formation of an effective angle to achieve the advantages of the invention.

Another optional but desirable feature of the embodiment of the invention depicted in FIGS. *5a* through *5d* is the use of a low friction finish on the cutting face 11, including rake land 508. The preferred low friction finish is a polished mirror finish which has been found to reduce friction between the diamond layer 502 and the formation material being cut and to enhance the integrity of the curing face surface. The reader is directed to U.S. Pat. No. 5,447,208 issued to Lund et at. for additional discussion and disclosure of polished superabrasive cutting faces.

Yet another optional feature applicable to the embodiment of FIGS. *5a* through *5d* and to the inventive cutter in general is the use of a small peripheral chamfer or radius at the cutting edge as taught by the prior art to increase the durability of the cutting edge while running into the borehole and at the inception of drilling, at least along the portion which initially contacts the formation. The inventors have, to date, however, not been able to demonstrate the necessity for such a feature in testing, the cutting edge may also be optionally honed in lieu of radiusing or chamfering, but again the necessity for such feature has yet to be demonstrated.

Another optional cutter feature usable in the invention feature depicted in broken lines in FIG. *5a* is the use of a backing cylinder 516 face-bonded to the back of substrate 503. This design permits the construction of a cutter having a greater dimension (or length) along its longitudinal axis 507 to provide additional area for bonding (as by brazing) the cutter to the bit face, and thus to enable the cutter to withstand greater forces in use without breaking free of the bit face. Such an arrangement is well known in the art, and disclosed in U.S. Pat. No. 4,200,159. However, the presence or absence of such a backing cylinder does not affect the durability or wear characteristics of the inventive cutter.

Figure 6:
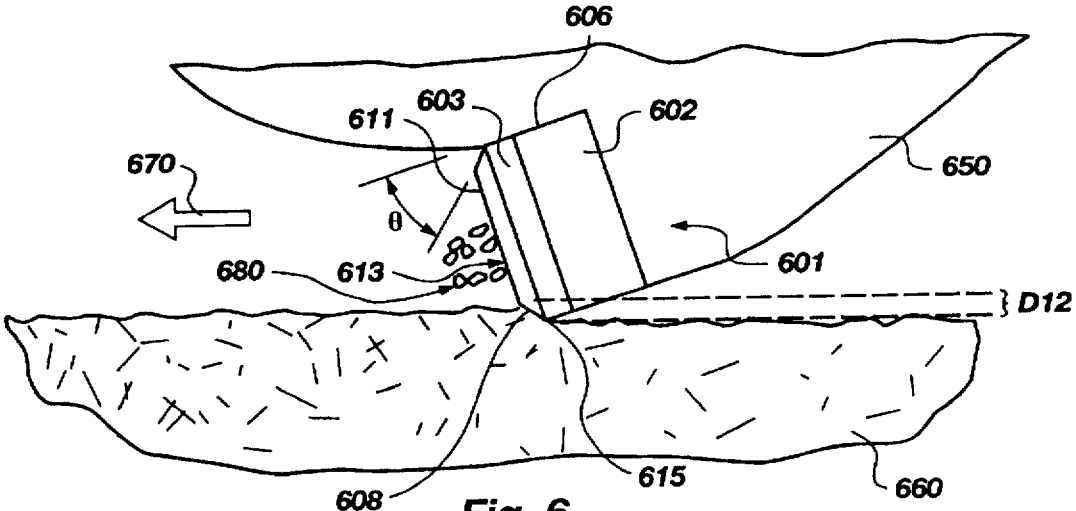
FIG. 6 depicts an embodiment of the invented cutter in use.
Figure 5A:
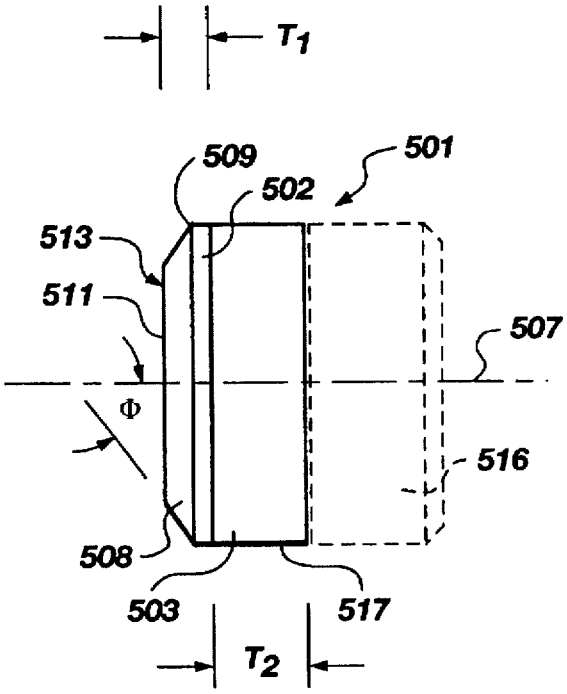
FIGS. 5a–d depict an exemplary preferred embodiment of the invented cutter.
Figure 5B:
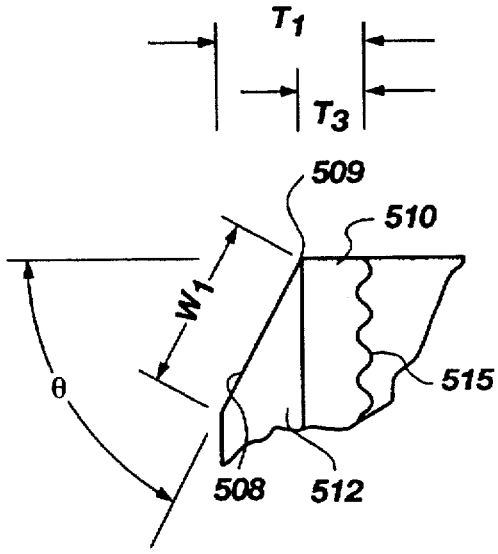
Figure 5C:
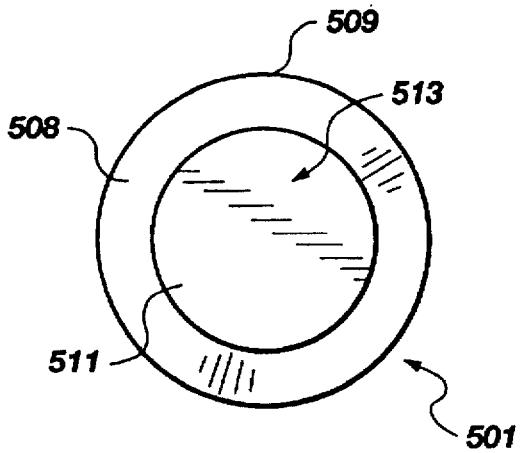
Figure 5D:
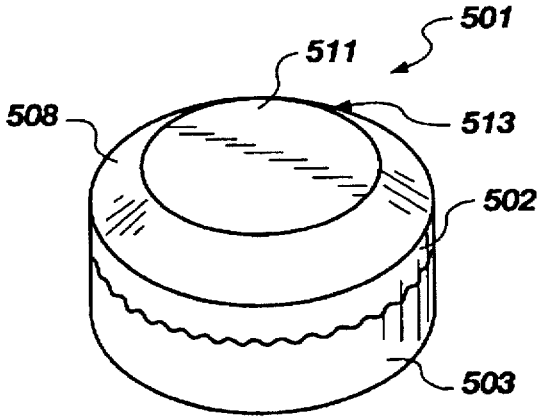

FIG. 6 depicts an embodiment of the invented cutter 601 in use on a bit 1250. The cutter 601 has a diamond layer 602 sintered onto a tungsten carbide substrate 603. The diamond layer 602 has a land 608 which has a rake angle Θ with respect to side wall 606. The cutter 601 has a curing face 613 with a central flat area 611. Cutting face 613 cuts the rock 660, contacting it at cutting edge 615. As the bit 650 with cutter 601 move in the direction indicated by arrow 670, the cutter 601 cuts into rock 660 resulting in rock particles or chips 680 sliding across the cutter face 613. The cutting action of the cutter 601 results in a cut being made in the rock 660, the cut having depth "$D_{12}$." It can also be seen from the figure that on the trailing side of the diamond layer 602 opposite the cut behind the cutting edge 615, there is diamond material extending contiguously behind the cutting edge 615 for DOC $D_{12}$. The inventors believe that the cutting action that takes place when the invented cutter is used may be more like a grinding action responsive to rapid changes in strain rates in the formation being cut as the cutter passes, as compared to a shearing action which is thought to occur when prior art cutters are used. The inventors also believe that a cutter employing the invented structural features may not necessarily undergo the self-sharpening phenomena mentioned in conjunction with FIG. 4. The thickened diamond table and rake land can serve to isolate the substrate of the cutter from erosion that permits self-sharpening of the diamond layer. The thickened diamond table and the rake land also have the effect of substantially isolating the diamond table/substrate interface from the cutting loads, and provide a higher stress gradient with respect to such loads. Thus, while the invented cutter is not as prone to self-sharpen as some prior art cutters were, it is also far more wear and impact resistant than prior art cutters, thus not requiring self-sharpening in order to achieve an effective cutter. Of course, it may be possible to configure a cutter so that it will employ the inventive concepts and achieve a self-sharpening action. Such a cutter would be considered to be a cutter within the scope of the invention.

Figure 7:
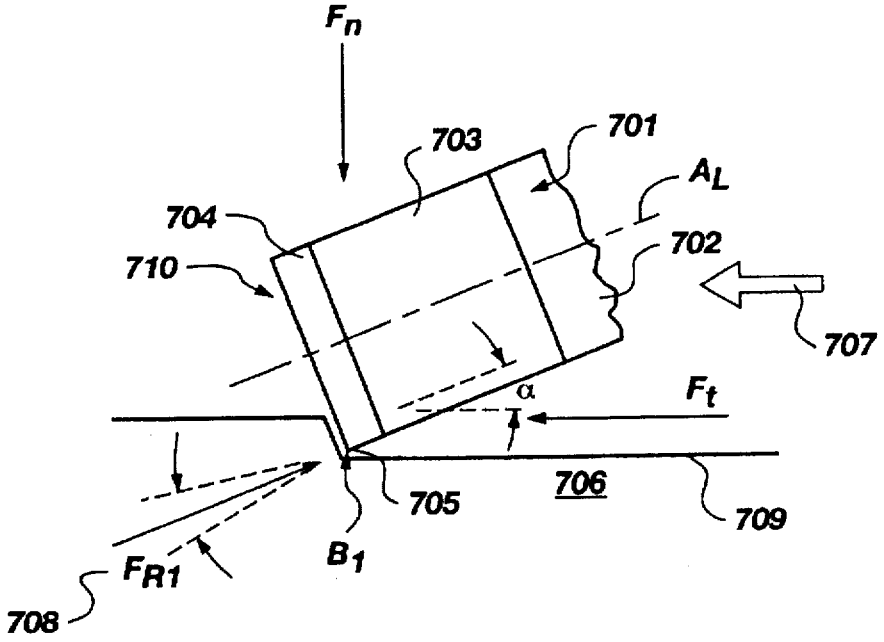
FIG. 7 depicts the loading of a prior art cutter during drilling.

Referring to FIG. 7, forces to which a conventional PDC cutter 701 is exposed during cutting are depicted. The cutter 701 which, for exemplary purposes is shown mounted to a stud 702, may include a substrate 703, and diamond layer 704 with cutting edge 705. As the cutting edge 705 is propelled against the rock 706 by forward movement of the stud 702 as indicated by arrow 707, a force is applied against the diamond layer 704 by the rock 706 as indicated by the resultant force vector $F_{R1}$ as indicated by reference numeral 708. The cutter 701 is actually moving in a shallow helical path and the cutting face 705 contacts the rock 706 at a point on a horizontal line 709 that is tangent to the circle in which the cutting face 705 moves. The resultant force vector $F_{R1}$ is applied against the cutting face 710 at an angle a, the angle a being measured from the horizon as indicated by line 709 (which is the same as a line tangent to the circle in which the cutting face 705 moves). The resultant force vector $F_{R1}$ is a reactive force vector comprised of two separate force components: $F_t$ which is a tangential force created by bit rotation and cutter 701 moving against the rock 706 during cutting (including torque on bit, shear force to fail the rock, and friction between the cutter and the formation, although the latter is relatively small), $F_t$ being oriented parallel to line 709 and $F_n$ which is a normal force attributable to weight on bit and exerted perpendicular to $F_t$ and toward the rock 706. In other words, $F_{R1}$ is the reactive force vector applied to cutting face 710 by the formation rock 706 in response to $F_t$ and $F_n$. It can be seen from FIG. 7 that the resultant force vector $F_{R1}$ is oriented in a direction within a range generally parallel to the longitudinal axis $A_L$ of cutter 701 and along the sidewall trailing cutting edge 705, depending on the relative magnitude of $F_t$ and $F_n$. As the resultant force vector $F_{R1}$ is oriented generally parallel to $A_L$ that force is being borne by the diamond layer 704, the substrate 703 and the interface therebetween in an area that includes substantial residual tensile stresses from the manufacturing process. Consequently, prior art cutters tended to spall, crack, chip and break regardless of the strength of the stud or substrate used. This propensity is due, as previously noted, to high bonding stresses, high $F_n$ (spalling), high $F_t$ (fracture) and the orientation of $F_{R1}$ which increases net effective stresses.

It may also be readily seen from FIG. 7 that the loading on the cutting face is also concentrated at cutting edge 705, resulting in high unit stresses on minute bearing area B1, and that a substantial portion of the resulting force vector F is oriented so as to initiate bending of the diamond table. Thus, previously noted, such conventional cutters possess an inherent disposition to failure from high loads.

Figure 8:
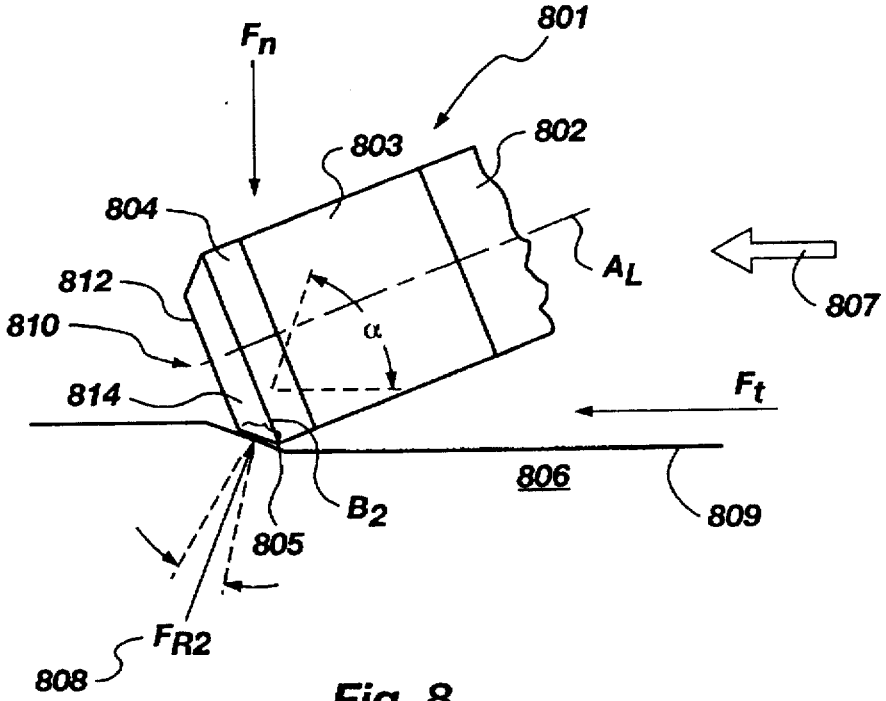
FIG. 8 depicts the loading of the invented cutter during drilling.

Referring to FIG. 8, forces to which the invented cutter 801 is exposed to during cutting are depicted. The cutter 801 which is mounted to stud 802, includes substrate 803, and diamond layer 804 with cutting face 810 including central area 12, rake land 814 and cutting edge 805. As the cutting edge 805 is propelled against the rock 806 by forward movement of the stud 802 as indicated by arrow 807, a force is applied against the diamond layer 804 by the rock 806 as indicated by the resultant force vector range $F_{R2}$ (reference numeral 808). The cutter 801 is actually moving in a circular direction along a shallow helical path and the cutting edge 805 contacts the rock 806 at a point on a horizontal line 809 that is tangent to the circle in which the cutting face 805 moves. The resultant force vector $F_{R2}$ is applied against the cutting face 810 at an angle α, the angle α being measured from the horizon as indicated by line 809 (which is the same as a line tangent to the circle in which the cutting face 805 moves). The resultant force vector $F_{R2}$ is a force vector created by two separate force components $F_t$ and $F_n$, as described above with respect to FIG. 7. From the figure, it can be readily seen how the presence of a large rake land 814 on cutting face 810 of the cutter 801 of the invention significantly changes the general angle α of the resultant force vector $F_{R2}$ so that the force is born by diamond layer 804, substrate 803 and the interface therebetween in a region more toward the cutter interior and longitudinal axis $A_L$ of cutter 801, rather than in a damage-susceptible area to the rear of the cutting edge. While tensile stresses may be present in the diamond in this central area, the force vector $F_{R2}$ tends to beneficially load this area in compression. The exact orientation of $F_{R2}$ is dependent upon rake land angle Θ as previously described, as well as on the relative magnitudes of $F_t$ and $F_n$. As a result, the diamond layer 804 exhibits a greatly lengthened service life and seldom fails in a catastrophic manner, as frequently occurs with standard cutters. Under very long term use, it has been found that the cutting face 810 of the invented cutter with a large rake land will tend to wear, but the serious prior art problems with catastrophic failures have been substantially reduced.

It may also be readily observed that the rake land of the invention lowers the unit stress on the cutting face by providing an enlarged bearing area B2. Further, when a thick diamond table is combined with the large rake land, a large stress gradient is provided across the diamond table and the result is an extremely long lasting and durable cutter. The thicker diamond table also generally provides a stiffer cutting structure and reduces the overall propensity of cracks in the diamond table to propagate to the point of cutter failure. Finally, the relative portion of the force vector acting on the cutting face in a direction tending to bend the diamond table (e.g., the bending stress) is reduced responsive to the angled rake land.

During testing which compared prior art cutters with the invented cutter by continuous shearing of a granite block at ambient atmospheric pressure, it was found that a state-of-the art polycrystalline diamond cutter of about 0.030 inches diamond table thickness and employing a small-chamfered cutting edge, a diamond bar stiffening structure behind and integral with the diamond table according to the aforementioned '403 patent, a tapered substrate according to the aforementioned '233 patent and a flat cutting face polished to a mirror finish according to the aforementioned '208 patent had a cutting capacity of 5000 cubic inches of rock before failure. A conventional "double thick" cutter of the same size (diameter), and of about 0.060 inches diamond table thickness and similar diamond material to the first cutter, but believed to be of better-sintered construction, failed at about 7200 cubic inches to 7800 cubic inches of rock. Another conventional cutter of the same size and diamond table thickness as the first cutter, of the same diamond material as the second and third cutters, without the stiffening structure but with a diamond table/substrate interface comprised of concentric ridges and valleys appearing as a sawtooth pattern when viewed in section, a small-chamfer cutting edge, a tapered substrate and a polished cutting face, failed at about 9200 cubic inches of rock cut. In the same testing, a polycrystalline diamond cutter according to the invention of about 0.090 inch diamond table thickness, having a 45° rake land angle and about 0.035 diamond table thickness (base layer thickness) between the cutting edge and the table substrate interface, of identical diamond structure to all but the first cutter tested, of the same size as the other cutters, without a chamfered cutting edge, a bar stiffening structure, a tapered substrate or a polished rake land (the center of the cutting face, however, being polished) but of the configuration of the invention, cut almost 23,000 cubic inches of rock without either catastrophic failure or reaching its wear limit. Additional rock could have been cut with the invented cutter being tested, but the advantages of the invention were believed to have been proven by cutting almost 23,000 cubic inches of rock. All of the test cutters were placed at a 20° back rake with respect to the work surface being cut.

The inventors also performed finite element analysis of prior art polycrystalline diamond cutters and of the invented cutter with a large rake land. They found that on prior art cutters, there is a region of very high residual stress in the diamond table/substrate interface area near the periphery of the cutter immediately behind the cutting edge. Prior art cutters exhibit spalling, cracking, chipping and breaking of the diamond layer ahead of the residual stress area, including at the cutting face, due to high unit stresses and orientation of the force vector acting on the cutting edge toward this high-stress area. This, of course, results in decreased service life and catastrophic failures of prior art cutters. The finite element analysis that the inventors performed on the invented cutter showed that the location in the substrate which under high residual stress component was far less highly stressed in the invented cutter due to thickness of the diamond table and reorientation of cutting load components by the rake land.

It is possible to selected different rake angles Θ in order to increase either cutting face strength or depth of cut. As Θ is increased, cutting edge loading decreases and depth of cut should increase, resulting in a corresponding increase in the rate of penetration through the formation for a given weight on bit. Conversely, as Θ is decreased, cutting edge loading increases, depth of cut decreases, and rate of penetration decreases for a given weight on bit.

Figure 9:
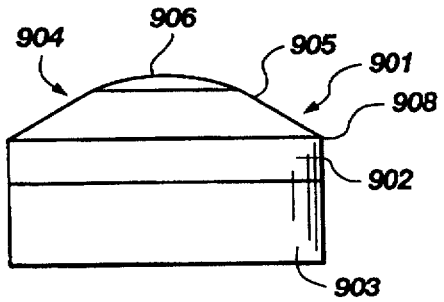
FIGS. 9–12 depict alternative embodiments of the invented cutter.

Referring to FIG. 9, a cylindrical cutter 901 with a diamond table 902 atop a substrate 903 is depicted. Cutting face 904 includes a rake land 905 extending to a center, convex area 906. Cutting edge 908 is longitudinally spaced from substrate 903.

Figure 10:
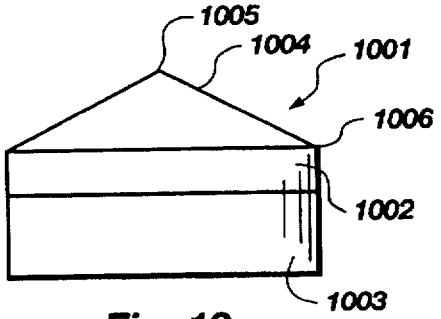

Referring to FIG. 10, an alternative embodiment of the invented cutter is depicted. The cutter is a cylindrical cutter with a conical proximal or loading end. The cutter 1001 has a diamond table 1002 atop a substrate 1003. The diamond table has a cutting edge 1006 and a rake land 1004. It can be seen from the figure that the rake land 1004 occupies the entire proximal or cutting face of the cutter 1001 and terminates in a conical point 1005.

Figure 11:
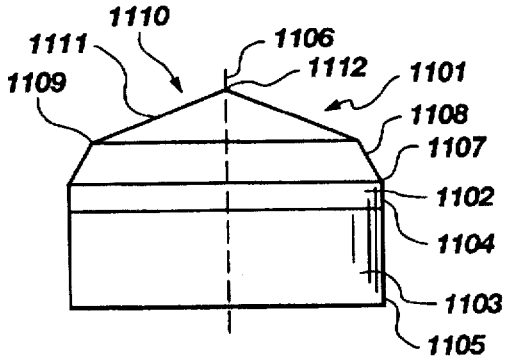

FIG. 11 depicts an alternative embodiment of the invention. The cutter 1101 has a diamond table 1102 atop a substrate 1103. The diamond table 1102 includes a first side wall 1104 that may be generally parallel either to the substrate side wall 1105 or to the longitudinal axis 1106 of the cutter. The diamond table also has a rake cutting edge 1107 where the rake land 1108 meets the first side wall. The cutting edge 1107 or the interface between the rake land and the first side wall 1104 forms the outer boundary of the rake land 1108. The rake land 1108 has an inner boundary 1109 which is the outer boundary of the central area of cutting face 1110. The rake land 1108 in this embodiment may be referred to as a second side wall which is formed at an obtuse angle to the first side wall. A third side wall 1111 formed at an obtuse angle to the second side wall or rake land 1108 proceeds to a conical point 1112 at the extreme proximal end of the cutter 1101.

Figure 12:
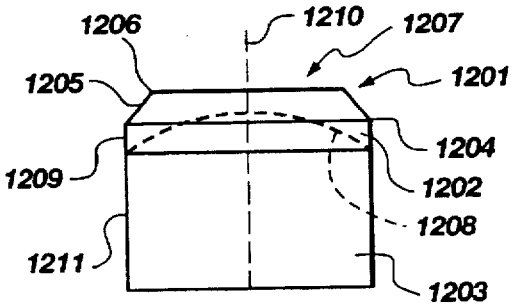

Referring to FIG. 12, an alternative embodiment of the invented cutter is shown. The cutter 1201 has a diamond layer 1202 atop a substrate 1203. The substrate 1203 is radiused or forms a dome 1208 beneath the diamond layer 1202. The diamond layer 1202 has a sidewall 1209 that is shown as being generally parallel to the substrate sidewall 1211 and to the longitudinal axis 1210 of the cutter 1201, but which could be angled otherwise. The diamond layer 1202 also includes a cutting edge 1204, a rake land 1205 and a central cutting face area 1207. The area 1207 is that portion of the proximal end of the diamond table 1202 within the inner boundary 1206 of the rake land.

Figure 13:
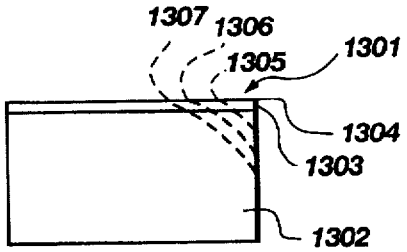
FIGS. 13–15 depict wear which occurs on an exemplary prior art cutter and on the invented cutter.

In the prior art there was some effort made to produce a cutter that was preworn in order to reduce chipping, spalling and catastrophic breakage soon after the cutter was placed in the bore hole. FIG. 13 depicts a prior art cutter 1301 having a diamond table 1303 atop a substrate 1302. It can be seen from the figure that when the prior art cutter 1301 is new, it has a sharp cutting edge 1304 at the outer periphery of the diamond table 1303. As the cutter 1301 wears, it loses its sharp cutting edge 1304 and tends to wear into the substrate 1302 in a rounded shape as illustrated by a progression denoted by reference numerals 1305, 1306 and 1307.

Figure 14:
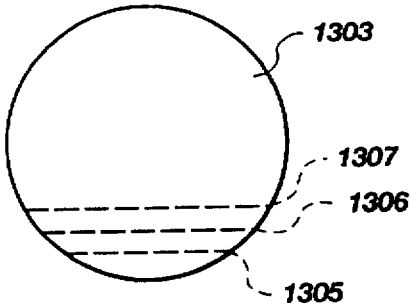

Referring to FIG. 14, the prior art cutter 1301 is also depicted. The cutter is shown from its diamond table 1303 or proximal end. A wear flat developing on the cutter 1301, primarily in the substrate 1302, is depicted using reference numerals 1305, 1306 and 1307 in progression.

It can be seen from FIGS. 13 and 14 that the worn prior art cutter does not assume the physical configuration of the invented cutter with large wear land. Instead, the prior art cutter forms an ever-longer, ever-wider wear flat primarily in the substrate material behind the diamond table. Further, the worn cutter of FIGS. 13 and 14 has a physical configuration determined by dynamic forces occurring within the bore hole and beyond the reasonable control of the user. Thus, prior art cutters which become worn achieve a particular physical configuration because of many random and uncontrollable factors, and it is not possible to wear a prior art cutter into a given desired configuration. As a result, the prior art cutter may have an incidental wear flat present on its exterior, but its configuration after it is worn is out of the control of the user. Even if it were desired to create a wear flat on a prior art cutter that approximates the geometry of the invented cutter, it would be necessary to position the cutter in a drag bit in a nearly vertical orientation. Use of a prior art cutter in such an orientation would provide very ineffective cutting, and would likely cause premature failure of the cutter. Even if such a flat were formed, it would be largely present in the substrate material and quickly increase in size. Thus, the inventors believe that it is very unlikely or impossible that use of a prior art cutter within a bore hole in a subterranean formation could wear a prior art cutter so that it has the geometry of the invented cutter.

Figure 15:
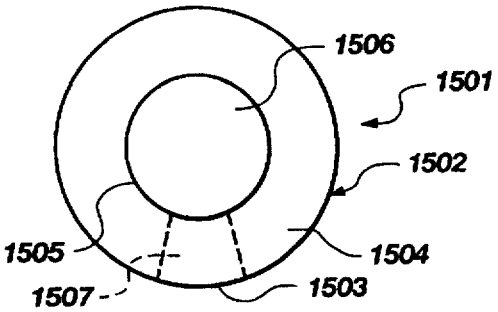

In FIG. 15, an end view of one embodiment of the invented cutter 1501 from its diamond table 1502 or proximal end is provided. The cutting edge 1503, rake land 1504, inner boundary 1505 of the rake land, and central cutting face area 1506 are all depicted. As the cutter 1501 is used, it will develop a wear flat 1507 that is only slightly broader adjacent the curing edge 1503 or periphery of the cutter (i.e. adjacent the cutter wall) than it is at the inner portion of the rake land known as the inner boundary 1505. Comparing the wear flat depicted in FIG. 15 to that of FIGS. 13 and 14, the reader can gain more appreciation of the advantageous dynamics of cutter shape over time provided by the invention.

Figure 16:
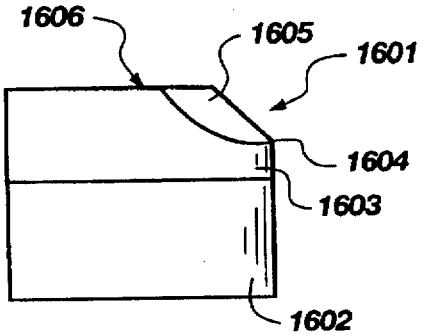
FIGS. 16–19 depict alternative embodiments of the invented cutter and geometries of those embodiments.
Figure 17:
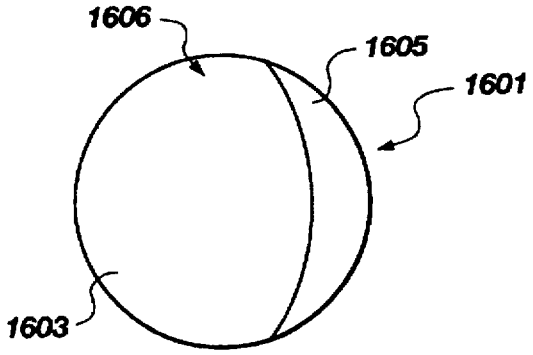

FIGS. 16 and 17 depict an alternative embodiment of the invention. The cutter 1601 has a substrate 1602 onto which a diamond table 1603 is formed. The diamond table 1603 has a cutting edge 1604, and a non-circular rake land 1605 along one side of a cutting face 1606. FIG. 17 shows an end view of the cutter 1601 from its proximal end (diamond table end). It can be seen from FIGS. 16 and 17 that the cutter 1601 has a rake land 1605 on only one side or along a portion of its lateral periphery. It is preferred to construct a cylindrical cutter with a rake land on the diamond table about its entire periphery. This is to permit rotation of the cutter in a receptacle on a bit so that when one portion of the cutting edge become worn, the cutter can be rotated and a fresh portion of the cutting edge used. A cutter as depicted in FIGS. 16 and 17, however, while not permitting extensive rotation and re-use of the cutter even after wear, will achieve the purpose of the invention.

Figure 18:
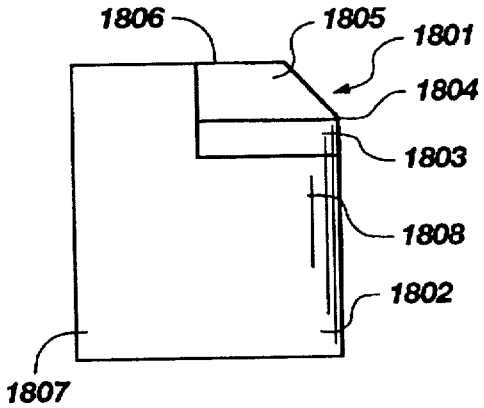
Figure 19:
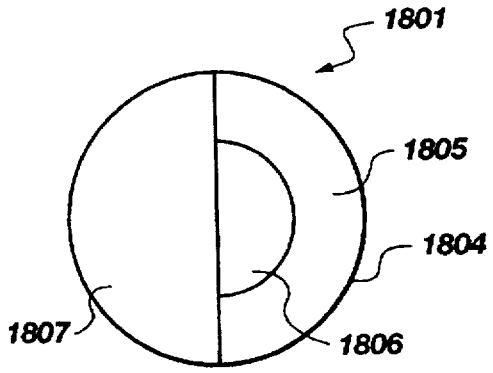
Figure 33:
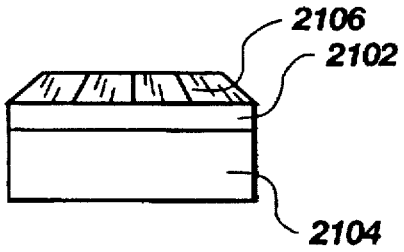
Figure 34:
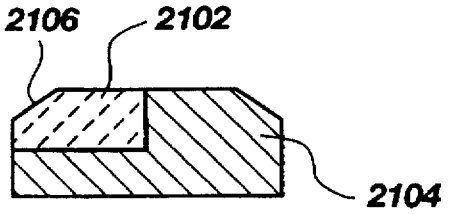
Figure 35:
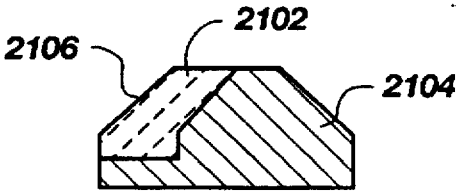
Figure 36:
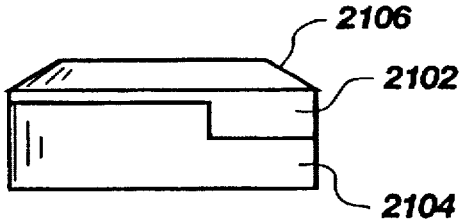
Figure 37:
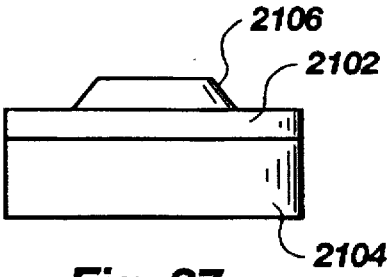
Figure 38:
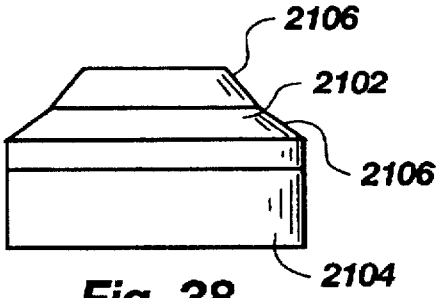

FIGS. 18 and 19 depict another embodiment of the invention. FIGS. 18 and 19 shows a cutter 1801 which includes a substrate 1802 and a diamond table 1803. The cutter 1801 has a curing edge 1804, a rake land 1805 and a central or inner cutting face area 1806. FIG. 33 depicts an end view of the cutter 1801 from its proximal (diamond table end). This cutter 1801 is in effect a half cutter, because while the substrate 1802 includes a full cylindrical portion 1807 to accommodate installing the cutter 1801 into a receptacle on a bit, the cutter 1801 has a diamond table 1803 that is a half cylinder. The substrate 1802 has a table supporting portion 1808 which is part of the full cylindrical portion 1807. This cutter does not accommodate full rotation about its longitudinal axis in a receptacle on a bit in order to maximize the useful life of the cutter, but it includes the invented structure and will provide the user with the advantages of the invention. The cutter could be a half cutter, a third cutter, a quarter cutter or any other portion of a full cylindrical cutter. Alternatively, a cutter which embodies the inventive concept could be made that is not cylindrical in shape. It is possible for a cutter with a thick diamond table and a large wear land to be constructed that is square, rectangular, triangular, pentagonal, hexagonal, heptagonal, octagonal, otherwise shaped as an n-sided polygon (where n is an integer), oval, elliptical, or shaped otherwise in a cross section taken orthogonal to the longitudinal axis of the cutter.

Figure 20:
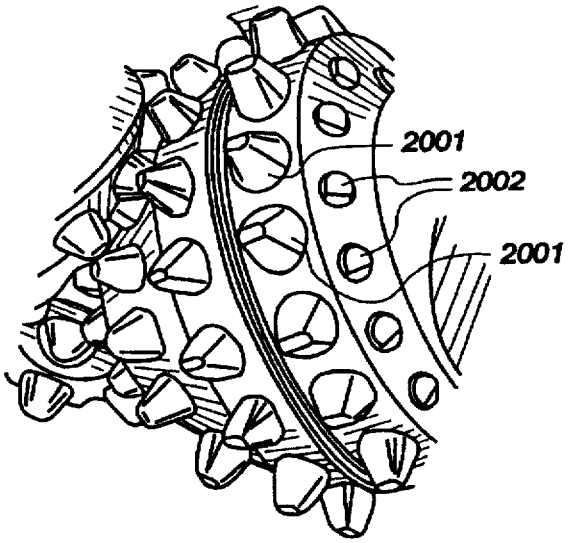
FIG. 20 depicts the invented cutter in use on an roller cone bit.
Figure 21:
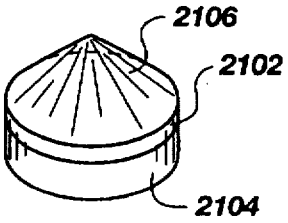
FIGS. 21–38 depict further alternative embodiments of the invented cutter.
Figure 22:
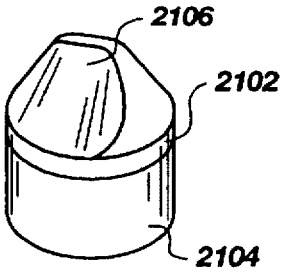
Figure 23:
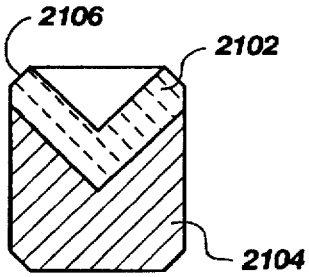
Figure 24:
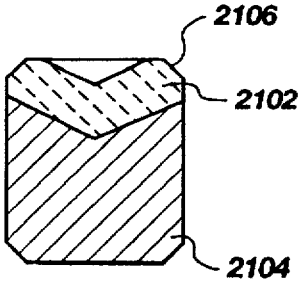
Figure 25:
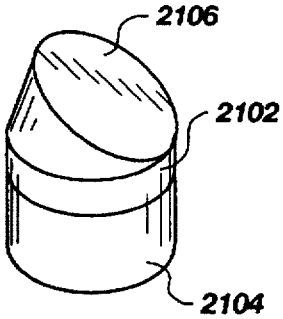
Figure 26:
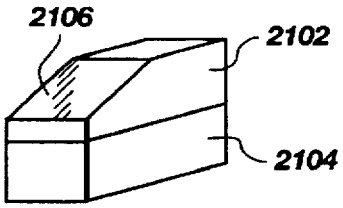
Figure 27:
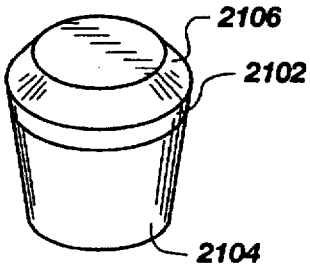
Figure 28:
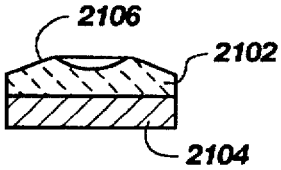
Figure 29:
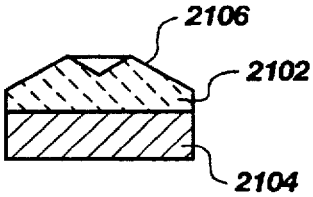
Figure 30:
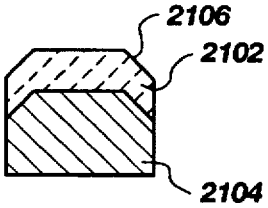
Figure 31:
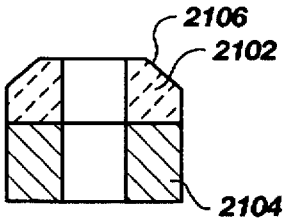
Figure 32:
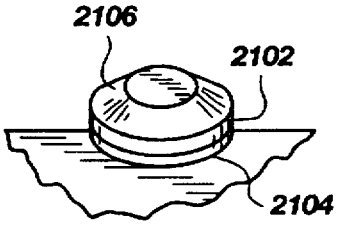

FIG. 20 depicts a side view of the invented cutters of two different physical configurations, 2001 and 2002, in use on a roller cone of a rock bit.

FIGS. 21–38 depict further alternative embodiments of the cutter of the invention. Diamond tables are identified by reference numeral 2102, substrates by 2104 and rake lands by 2106.

With the use of the invented rake land, the inventors believe that the invented cutter will, when in use in a bore hole, contact the formation being cut with a longitudinally-extending, arc-shaped area of the cutter along the cutting edge. In contrast, the inventors believe that new prior art cutters contacted the formation being cut at a single point or transversely-extending line on the cutting edge. The longitudinal, arc-shaped region of contact on the rake land between the invented cutter and the formation distributes the force of impact against the cutter over a larger superabrasive surface in the invented cutter than in the prior art, hence lowering unit stress on the cutter. This distribution of forces over a larger surface area, in combination with reorientation of $F_R$ and enlargement of the stress gradient due to use of a thicker diamond table, increases the impact resistance of the invented cutter.

The invented cutter improves cutter wear performance by providing a cutter which has been found to cut a greater volume of subterranean formation than a typical prior art cutter of similar diameter and composition. The invented cutter has also been found to have greater impact resistance than prior art cutters. The invented cutter also has improved erosion resistance and abrasion resistance compared to prior art cutters. These improved performance attributes are believed to be attributable primarily to the use of a large rake land.

The diamond table may be made from polycrystalline diamond or thermally stable polycrystalline diamond, depending upon the application. In lieu of a polycrystalline diamond table, a cutting table or compact of any of the following types could be used in the cutter: diamond film (including CVD), cubic boron nitride, and a structure predicted in the literature as $C_3N_4$ being equivalent to known superabrasive materials. Additional suitable materials may exist and be used to form a cutter table as well. The curing table would serve the same function as the diamond table, and would have the same general structural features as the diamond table in the invented cutter. A cutter which uses material other than diamond in the cutter table and includes other features of the invention is considered a cutter of the invention.

It is preferred that cutters of the invention be manufactured using the manufacturing process described in the Background of this document. This includes compressing diamond particles adjacent a suitable substrate material under high pressure and high temperature conditions to form a diamond table that is sintered to the substrate. Of course, if materials other than diamond particles are used for the cutter table, or if materials other than a cemented carbide, such as tungsten carbide (WC) are used for the substrate, then the manufacturing process may need to be modified appropriately. The inventors contemplate that numerous substrates other than tungsten carbide may be used to make the invented cutter. Appropriate substrate materials include any cemented metal carbide such as carbides of tungsten (W), niobium (Nb), zirconium (Zr), vanadium (V), tantalum (Ta), titanium (Ti), tungsten Ti) and hafnium (Hf).

It is an advantage of the invention that a cutter is provided that has a large or wide rake land that increases the effective back rake of the cutter as it is presented to the formation by the bit face. The actual angle of contact of the cutting face with the formation (and thus the effective back rake) is determined in part by the angle of the wide rake land on the cutter. This permits adjustments to cutter effective back rake without altering the orientation of a cutter on the bit face, by employing cutters according to the invention having different rake land angles.

While the present invention has been described and illustrated in conjunction with a number of specific embodiments, those skilled in the art will appreciate that variations and modifications may be made without departing from the principles of the invention as herein illustrated, described and claimed. Cutting elements according to one or more of the disclosed embodiments may be employed in combination with cutting elements of the same or other disclosed embodiments, or with conventional curing elements, in paired or other grouping, including but not limited to, side-by-side and leading/trailing combinations of various configurations. The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A cutting element for use on a bit for drilling subterranean formations, said cutting element having a longitudinal axis and comprising:

a volume of superabrasive material including:

a cutting face extending in two dimensions and generally transverse to said longitudinal axis;

a cutting edge at a periphery of said cutting face;

a rear boundary trailing said cutting edge at a longitudinal distance of no less than about 0.015 inch; and a rake land on said cutting face extending forwardly, inwardly and away from said cutting edge at an acute angle to said longitudinal axis; and wherein said volume of superabrasive material has a depth, measured parallel to said longitudinal axis and adjacent said cutting edge of not less than about 0.070 inch and not more than about 0.150 inch.

2. The cutting element of claim 1, wherein said rake land includes a width extending from said cutting edge forwardly and inwardly along the surface of said rake land of not less than about 0.050 inch measured along the surface of said rake land.

3. The cutting element of claim 1, wherein said superabrasive material includes a sidewall between said cutting edge and said rear boundary.

4. The cutting element of claim 3, wherein said sidewall is substantially parallel to said longitudinal axis.

5. The cutting element of claim 3, wherein said rake land is oriented at an angle of between about 10° and about 80° with respect to said sidewall.

6. The cutting element of claim 3, wherein said rake land is oriented at an angle of between about 30° and about 60° with respect to said sidewall.

7. The cutting element of claim 1, wherein said rake land is oriented at an angle of about 10° and 80° with respect to said longitudinal axis.

8. The cutting element of claim 1, wherein said rake land is oriented at an angle of about 30° and 60° with respect to said longitudinal axis.

9. The cutting element of claim 1, wherein said cutting element includes an arcuate periphery at said cutting edge.

10. The cutting element of claim 1, wherein said rake land is arcuate.

11. The cutting element of claim 1, wherein said cutting element is circular, said cutting edge is arcuate, and said rake land extends radially inwardly toward said longitudinal axis.

12. The cutting element of claim 11, wherein said rake land extends at least to said longitudinal axis.

13. The cutting element of claim 11, wherein said rake land lies between said cutting edge and a central cutting face area.

14. The cutting element of claim 13, wherein at least a portion of said central cutting face area is substantially planar.

15. The cutting element of claim 13, wherein at least a portion of said central cutting face area is convex.

16. The cutting element of claim 13, wherein at least a portion of said central cutting face area is concave.

17. The cutting element of claim 1, wherein a portion of said volume of superabrasive material is affixed to a portion of a substrate element.

18. The cutting element of claim 17, wherein said substrate element is affixed to said volume of superabrasive material proximate said rear boundary.

19. The cutting element of claim 17, wherein said substrate element is affixed to said volume of superabrasive material to the rear of said cutting edge.

20. A cutting element for use on a bit for drilling subterranean formations, said cutting element having a longitudinal axis and comprising:

a volume of superabrasive material including:

a cutting face extending in two dimensions and generally transverse to said longitudinal axis;

a cutting edge at a periphery of said cutting face; and a rake land on said cutting face extending forwardly, inwardly and away from said cutting edge at an acute angle to said longitudinal axis for a width of no less than about 0.050 inch measured along the surface of said rake land; and wherein said volume of superabrasive material has a depth, measured parallel to said longitudinal axis and adjacent said cutting edge, of not less than about 0.070 inch and not more than about 0.150 inch.

21. The cutting element of claim 20, wherein said volume of superabrasive material further includes a rear boundary trailing said cutting edge at a longitudinal distance of not less than about 0.015 inch.

22. The cutting element of claim 21, wherein said superabrasive material includes a sidewall between said cutting edge and said rear boundary.

23. The cutting element of claim 21, wherein said sidewall is substantially parallel to said longitudinal axis.

24. The cutting element of claim 21, wherein said rake land is oriented at an angle of between about 10° and about 80° with respect to said sidewall.

25. The cutting element of claim 21, wherein said rake land is oriented at an angle of between about 30° and about 60° with respect to said sidewall.

26. The cutting element of claim 20, wherein said rake land is oriented at an angle of between about 10° and 80° with respect to said longitudinal axis.

27. The cutting element of claim 20, wherein said rake land is oriented at an angle of between about 30° and 60° with respect to said longitudinal axis.

28. The cutting element of claim 20, wherein said cutting element includes an arcuate periphery at said cutting edge.

29. The cutting element of claim 28, wherein said rake land is arcuate.

30. The cutting element of claim 20, wherein said cutting element is circular, said cutting edge is arcuate, and said rake land extends radially inwardly toward said longitudinal axis.

31. The cutting element of claim 30, wherein said rake land extends to said longitudinal axis.

32. The cutting element of claim 30, wherein said rake land lies between said cutting edge and a central cutting face area.

33. The cutting element of claim 32 wherein at least a portion of said central cutting face area is substantially planar.

34. The cutting element of claim 32, wherein at least a portion of said central cutting face area is convex.

35. The cutting element of claim 32, wherein at least a portion of said central cutting face area is concave.

36. The cutting element of claim 20, wherein said volume of superabrasive, material is affixed to a portion of a substrate element.

37. The cutting element of claim 36, wherein said substrate element is affixed to said volume of superabrasive material proximate said rear boundary.

38. The cutting element of claim 36, wherein said substrate element is affixed to said volume of superabrasive material to the rear of said cutting edge.

39. An apparatus for use in drilling subterranean formations, comprising:

a body presenting an exterior surface having at least one cutting element secured thereto;

said at least one cutting element having a longitudinal axis and comprising a volume of superabrasive material including:

a cutting face extending in two dimensions and generally transverse to said longitudinal axis;

a cutting edge at a periphery of said cutting face; and a rake land on said cutting face extending forwardly, inwardly and away from said cutting edge at an acute angle to said longitudinal axis for a width of no less than about 0.050 inch measured along the surface of said rake land; and wherein said volume of superabrasive material has a depth, measured parallel to said longitudinal axis and adjacent said cutting edge, of not less than about 0.070 inch and not more than about 0.150 inch.

40. The apparatus of claim 39, wherein said rake land is oriented at an angle of between about 10° and 80° with respect to said longitudinal axis.

41. The apparatus of claim 39, wherein said rake land is oriented at an angle of between about 30° and 60° with respect to said longitudinal axis.

42. The apparatus of claim 39, wherein said body is selected from the group comprising: a drag bit body, a rolling cone bit body, a cone for a rolling cone bit, a mining bit body, a reamer, a stabilizer, a tool joint, a wear knot and a steering tool.

43. An apparatus for use in drilling subterranean formations, comprising:

a body presenting an exterior surface having at least one cutting element secured thereto;

said at least one cutting element having a longitudinal axis and comprising a volume of superabrasive material including:

a cutting face extending in two dimensions and generally transverse to said longitudinal axis;

a cutting edge at a periphery of said curing face;

a rear boundary trading said cutting edge at a longitudinal distance of no less than about 0.015 inch; and a rake land on said cutting face extending forwardly, inwardly and away from said cutting edge at an acute angle to said longitudinal axis; and wherein said volume of superabrasive material has a depth, measured parallel to said longitudinal axis and adjacent said cutting edge, of not less than about 0.070 inch and not more than about 0.150 inch.

44. The apparatus of claim 43, wherein said rake land includes a width extending from said cutting edge forwardly and inwardly along the surface of said rake land of not less than about 0.050 inch measured along the surface of said rake land.

45. The apparatus of claim 43, wherein said body is selected from the group comprising: a drag bit body, a rolling cone bit body, a cone for a rolling cone bit, a mining bit body, a reamer, a stabilizer, a tool joint, a wear knot and a steering tool.

46. The apparatus of claim 43, wherein said rake land is oriented at an angle of between about 10° and 80° with respect to said longitudinal axis.

47. The apparatus of claim 43, wherein said rake land is oriented at an angle of between about 30° and 60° with respect to said longitudinal axis.

* * * * *